US006354058B1

(12) United States Patent
Lewis

(10) Patent No.: US 6,354,058 B1
(45) Date of Patent: Mar. 12, 2002

(54) METHOD AND APPARATUS FOR LAYING TILE

(76) Inventor: Christopher H. Lewis, 1078 Palafox Dr., Atlanta, GA (US) 30324

( * ) Notice: Subject to any disclaimer, the term of this patent is extended or adjusted under 35 U.S.C. 154(b) by 0 days.

(21) Appl. No.: 09/586,226

(22) Filed: Jun. 2, 2000

Related U.S. Application Data

(60) Provisional application No. 60/137,083, filed on Jun. 2, 1999.

(51) Int. Cl.[7] ..... E04D 15/00

(52) U.S. Cl. ..... 52/749.11; D8/47; 254/104; 52/747

(58) Field of Search ..... 52/746.12, 747.11, 52/749.11, 747.12; 33/526, 527, 613, 645, 533, 679.1, 501.45

(56) References Cited

U.S. PATENT DOCUMENTS 4,953,341 A * 9/1990 Joos ..... 52/747
5,290,012 A * 3/1994 Cottriel et al. ..... 254/104
D421,374 S * 3/2000 Montgomery ..... D8/47

* cited by examiner

*Primary Examiner*—Carl D. Friedman
*Assistant Examiner*—Steve M Varner
(74) *Attorney, Agent, or Firm*—Todd Deveau; Ryan A. Schneider; Troutman Sanders LLP

(57) ABSTRACT

The present invention overcomes several disadvantages in conventional tile installation by providing tile regulators and a method of using them that provide both the proper grout spacing between tiles and vertical and horizontal plumb levels of the tiles, which regulators enhance the ease of installing the tiles and the final appearance of the newly laid tile. The present tile regulators are designed to compensate for the existing limiting conditions associated with conventional regulating products.

12 Claims, 4 Drawing Sheets

METHOD AND APPARATUS FOR LAYING TILE

This application claims benefit of Prov. No. 60/137,083, filed Jun. 2, 1999.

FIELD OF THE INVENTION

This invention relates generally to an improved method and apparatus for laying tile. In particular, this invention relates to a method of using tile regulators to provide both the proper grout spacing, and vertical and horizontal plumb levels, to enhance the ease of installing tile and the final appearance of newly laid tile. The tile regulators of the present invention vary in several characteristics, for example, shape, pitch and color that further simplify the tiling process.

TECHNOLOGY FIELD

Tile provides not only an especially esthetically pleasing look, but also a durable surface for a variety of residential and industrial settings. Tile work is generally considered an improvement upgrade to a kitchen, floor, bathroom, and the like, where ceramic tile is installed on the underlayment of either a floor or wall, or both.

With the strong, present economy, individuals and businesses have generated a greater amount of disposal income that can be put toward general home and business improvements. A vast majority of these improvements comprise an element of new tile work to a kitchen and bathroom, as the walls and floors are reconditioned and upgraded to new ceramic tile surfaces. Even without the present robust economy, there has always been, and will remain, a large amount of ongoing tile work associated with new construction.

Further, there has also been a concurrent explosion in the construction of home improvement mega-stores which supply the every expanding class of do-it-yourselfers (those finding more pleasure in tackling home and business projects themselves than hiring outside contractors) with the parts and confidence to complete their own improvement jobs. This growth has, in turn, produced a large market of home and business improvement books, Internet services providing step-by-step instructions, and several new TV shows and video programs for the do-it-yourselfers.

The present invention provides novel tile regulators and a method of using them that is simple enough to be employed by one with little or no skill in laying tile. The present invention is further economically justified for use by experienced contractors since the present invention shaves valuable time off the average professional job, and produces a better aligned tile surface which lowers the repair cost of mislaid tile.

Conventional Tile Installation

Ceramic tile is an attractive and exceptionally durable material for walls and floors of a bathroom, kitchen or any room that needs a durable and easily maintained surface. Laying tile is not particularly difficult for the novice, but does require preparation and some time.

Several distinct steps are necessary between simply deciding to tile a specific surface, and a finished tiled wall or floor. These steps include, for example, choosing the type of tile, choosing the type of adhesive the preparation of the underlayment and surface, and various other steps to both layout and install the tiles.

Choosing the right ceramic tile is typically difficult part of a tile project for the homeowner business owner. There are literally thousands of colors, sizes, styles, shapes and grades of tile. Presently, white and almond color are the most common for tiles, although designs with more color have gained in popularity. Colors are getting warmer and brighter, as well as clearer and cleaner. The most popular tile sold is 4¼" square wall tile. However, a current trend is towards larger tiles, for example, 8"×8" to 12"×12".

Small one-inch tiles also are common. These 1"×1" tiles are sometimes referred to as mosaic tile because they can be mixed with different colors to create borders, patterns, and even pictures. Mosaic tile may be joined together in, for example, 12"×12" or 12"×24" sheets to make them easier and quicker to set.

The materials that makes up tile, and the methods of manufacturing, determine the tile's durability, appearance and absorption. Most ceramic tile is glazed. Glazed tile is produced from a mixture of clays that are pressed into a particular shape. A "glaze" is then applied to the top of the tile and baked on. Glazed tiles are typically available in high-gloss, matte, and abrasive, slip-resistant finishes. Glazed tiles also come in decorative styles with a pattern or hand-painted design. Since glazed tiles tend to get scratched frequently when used on floors and countertops, they are typically used on walls. Floor tile should have a finish that is not too slippery for walking on, and that does not show scratches easily. Small, mosaic tile is made up from different types of clay, with various color pigments added. Mosaics are suitable for almost any surface because they resist moisture, are stain-proof and will not chip easily.

Quarry tile is a broad classification for any tile made out of a mixture of clays. They are usually deep red in color and are left unglazed. These types of tile are frequently used for interior floors because of their porousness and irregular shapes. The surfaces of quarry tile may be sealed or unsealed, although they typically stain if left unsealed.

Natural materials like slate, marble, granite, and limestone, cut into thin pieces and installed like tile are also popular. Alternatively, natural-looking tiles that resemble marble, slate, limestone and granite are just as durable, and cost as much as 75 to 80 percent less than using the natural material.

Most lines of tile comprise some special tiles for creating borders and accents, and for finishing corners and edges. Sometimes, these special tiles, bullnose tiles, will be rounded at the edges. A single-edged bullnose tile can be used to finish off the top of a wall, like a bathtub surround, or the edge of a countertop. A double-out bullnose has two rounded edges for finishing off the corner of a tile section. Edge tile is used for around the overhang of a countertop. Further, the bottom row of wall tile is generally made up of special base tiles. Base tiles are flared at the bottom and make a smooth transition to the floor. The top of a base tile is square to butt up to the regular wall tile.

Pattern options available when laying tile are virtually endless. However, there are two basic patterns in common usage. The "jack-on-jack" pattern is the most common, where the tile is laid like squares on a checkerboard. A "running bond" pattern has offset grout lines for every other row. While both are fairly easy to set, the running bond pattern is generally the more difficult of the two.

After settling on a particular tile line, the proper adhesive for the job must be addressed. The type of adhesive used depends on the location of tiling, and the surface (underlayment) under the tiling. Thinset adhesive can support a lot of weight so it is often used for floor installations. Thinsets also can be used in wet areas as well as those exposed to heat. Thinset adhesives come in powder form and must be mixed with either water, liquid latex, or an acrylic additive depending on the type. Thinsets are considered harder to work with because they must be mixed to the right consistency before using. Thinsets have a stronger bond and are more flexible than organic mastics.

Organic mastics are the most commonly used adhesives by do-it-yourselfers. They are pre-mixed and ready-to-use, thus considered easier to work with and less time consuming than thinset adhesives. Mastics are good for setting wall tile because they start gripping the tile even before the mastic is fully cured. Mastics have their drawbacks, as should not be used in areas that will get wet or will be exposed to extreme heat.

The final preparatory step before the start of a tile job is selecting the tools needed for the job. Many different tools are used for preparing and setting tile. A tile cutter is the best tool for quick and accurate straight cuts. It holds the tile in a frame as a cut line is scored with a small wheel. For repeatable, clean cuts, the scoring wheel may be replaced often. The tub saw, used mostly by professionals for straight cuts, gives clean, smooth edges. It cuts with a diamond-blade that is bathed in water to keep it cool.

A tile nipper is used for irregular cuts. First, a cut line is scored with a glass cutter or utility knife. Then, the tile nipper nibbles off small bits of tile until the proper shape is achieved. Since tile nippers can leave jagged edges on tile, the tile is generally used in less visible areas, or where it will be covered with trim, like around plumbing fixtures. Another tool for creating irregular cuts is a rod saw having a carbide-grit blade. For perfect circle cuts, like around faucets or supply lines, a carbide-tipped hole saw bit with a power drill works best. The rough edges may be smoothed with sandpaper.

Notched trowels are used to spread and "comb" adhesives onto the underlayment. Generally, two sides of the trowel are notched with either "V" or "square-shaped" notches. A square-notched trowel is typically used to set thinsets on horizontal surfaces. V-notched trowels are used for setting mastics on vertical surfaces. Notched trowels come in different notch depths.

Grout floats are rubber or foam-faced trowels used to force grout into the joints between the tiles. Diagonally and back and forth sweeping motions work the grout into the joints.

A leveling board is yet another tool that can be made from a length of 2"×4" or a masonry level. The leveling board is placed over several tiles and gently tapped with a hammer to level the tiles in the adhesive. Lastly, a layout tool (sometimes called a jury stick) is a stick or board having marks to indicate tile spacing. It is used during the layout phase of a project to obtain the correct placement of tile.

After the final selection is made on the line of tiles, adhesive and tools, preparation of the surface to be tiled may begin. Because ceramic tile is rigid and somewhat brittle, a strong underlayment is the most important part of tile installation. New tile installation is only as good as the underlying floor. Thus, the subfloor must be adequate to support tile. Since tile can be heavy, it must be installed on a flat surface that is rigid. Subfloors under tile are typically no less than 1⅛" thick. A flexing floor causes cracks to show up in the grout in the future, and may even cause tiles to break. If the floor "bounces" when walked over, rigidity can be added by renailing the subfloor to the floor joists. Bridging between the joists also may be added, and/or shimming the subfloor with wooden shims driven between the top edge of the joists and the bottom face of the subfloor. The surface on which the tile is installed must be smooth and free from debris, grease or wax. Uneven floors, bumps or dips also can cause tile to break. Typically, uneven or damaged floors are best covered first with an underlayment to use as the tile base. One-half inch thick cement board is often recommended by tile manufacturers.

Other underlayment constructions include plywood that can be fastened with drywall screws every six inches on the edges and eight inches in the field. Ring-shank nails may be used. The heads of the screws or nails should be driven in below the surface of the plywood. In high-moisture areas, such as a bathroom floor, an isolation membrane is generally applied over a wood underlayment. This is a thin rubber-like material that will protect the tile from the expansion and contraction of the wood subfloor caused by temperature and humidity changes.

Backerboard can also be used, and has a solid concrete core and is faced on both sides with fiberglass. It is not damaged by water, which makes it ideal for bathroom and kitchen installations. Backerboard is installed much like a plywood subfloor except that it also needs to "set" on the subfloor using the same type of thinset adhesive that is used to set tiles.

Professional tile contractors often put down a mortar, or "mud" bed. It consists of a layer of roofing felt, a wire mesh, and then mortar. While a mortar bed is by far the best underlayment for floor tile, it takes a lot of skill to finish it off level and at just the right thickness.

A tile floor in a shower requires a shower pan be installed. A shower pan is a waterproof membrane designed to hold water, not just shed it. This membrane is secured to the mortar bed of a shower with adhesive. It is creased at the corners and is run up the sides of the shower to form a pan. The center of the membrane is cut out for the drain. Another layer of mortar goes over the membrane and is sloped down to the drain.

Although a tile wall does not need to support the weight that a tile floor does, the underlayment still must be flat, solid and secured well to the framing. When preparing new walls for tiling, the walls first are sealed with a thin coat of adhesive, taking care to pack any openings where pipes come through. When preparing existing walls to receive tile, flexible coverings are stripped off such as wallpaper and loose paint. When installing wall tile in a bathroom, an ⅛" space typically is left along the area where the wall meets the top of a tub or shower base. This is caulked later with silicon caulk. Caulk is flexible enough to allow movement, settling or expansion and contraction, without cracking.

Drywall is a standard wall covering in most residential construction. It is not considered a good underlayment for wall tile. Water-resistant drywall, or "greenboard" is made out of the same gypsum core as drywall. The only difference is that it has a water-resistant facing. Greenboard can be used as an underlayment in damp areas such as bathroom walls where no bathtub or shower exist, or kitchen backsplaces. Concrete backerboard or a mudset with felt underlayment are the best materials to be used for tub surrounds and showers.

After the underlayment is prepared, tile is typically laid out on the underlayment to prepare various reference points and lines used layer in the actual tiling process. A row of floor tiles area are test-fit along each reference line to see how they lay out. The thickness of the grout lines are accounted for in this layout. While professional tile setters may only need a couple of reference lines to set tiles evenly, do-it-yourselfers should prepare more lines. Laying out sections, or a grid pattern, helps keep the tile straight and square. To layout a grid system correctly, one should begin with the basic essentials of the 3-4-5 triangle or the Pythagorean Theorem. Once a right angle has been established on the floor or wall all reference lines can be established for where to begin to lay tile. From the intersection of new reference lines, more tile is laid (about 2 or 3 square feet).

The basic principle of any tile layout is that full tiles are placed in the most visible areas of a room, and cut tiles hidden in less visible areas. One should not simply start laying tile in a corner and work outward.

Floor tiles are best centered in the room at a doorway for visual appearance or a prominent window. The center of two opposite walls are first measured, and these points used to snap a chalkline across the length of the room in the center of the floor, dividing the room in half. Another chalkline is snapped perpendicular to the first so the two lines cross in the center of the room. A row of tiles are dry-fit down both lines to the width and length of the room, while leaving a little spacing for the grout joints.

For tile layout on a wall, first the layout tool should be made. An easy way to do this is to lay out a row of tiles on the floor which are properly spaced. Both the width of the tile and of the grout lines must be considered. A straight stick is aligned with an edge against or on top of the row of tiles, and marked with the tile and grout spacing. This tool is in combination with a level to accurately layout the tile spacing on the walls.

Then, the planned location of any cabinets or accessories which are expected to hang on the wall are marked on the jury stick. If the job entails tiling a bathroom, one tile width plus ⅛" is generally measured up from the lowest spot where the top of the tub meets the wall. If the job is tiling a room with no tub or other obstruction, only one tile width is measured up from the floor's lowest point. With this mark as a beginning reference, the layout tool can provide an estimate of how the tiles will lay in a vertical line.

Once the layout is established, the tile is set. The floor surface must be clean of dust and debris. Concurrently, the tile adhesive only in the amount to be used within 2–3 hours is prepared, which prevents the adhesive from drying out. The full tiles are set first, leaving any cut tiles around the perimeter of the room for last. To install floor tile, the tile is laid from the center of the floor where the two final reference lines cross. A tile at the intersection of the lines is first placed, then, using the lines as a guide, tiles are laid outward toward the walls in each quadrant. The adhesive is spread with the trowel's notched edge, combing it out in beaded ridges. Spaces between ridges of adhesive should be almost bare.

Starting at the center of the floor, adhesive is spread evenly within one section using a notched trowel. Using the notched edges of the trowel, the adhesive is combed out. The top of the adhesive should have a uniform height. If the adhesive is too dry, the ridges won't comb out evenly and there tends to be gaps. If the adhesive is too wet, the ridges won't hold and they will all blend together.

The first tile in a corner is laid and twisted into the adhesive. About 70–80 percent of the tile backing should be covered with adhesive upon inspection. The remaining tiles are then set aligned to the outside layout lines. Keeping consistent spacing between the tiles is critical for straight, uniform grout lines. Some tiles come pre-mounted on paper grids so the spacing is already established. Once the tiles are in place, they are set into the adhesive so that they are all at the same height.

After setting all of the full tiles one can measure, cut and set the tile around the edges. If installing a tile floor that runs longer than 24 feet, or if the floor is near an outside wall or exposed to areas that will expand due to temperature and moisture changes, one will need to account for expansion joints. Expansion joints are simply breaks in the tile field that protect and cushion the tile from movements in the underlayment. In most homes, expansion joints can be made by stopping the perimeter tile ¼ from the wall.

Sometimes it is difficult to trowel the adhesive directly on the floor, like under cabinets or in small areas. In these cases, the tiles need to be "back buttered" individually. That is, the adhesive is spread on the back of the tile with a notched trowel. If the tile is too small, a margin trowel also can be used to spread the adhesive and scratch in notches with the edge of the trowel.

Wall tile installation requires that the wall surface be thoroughly clean of dust and debris. A level board then is attached to the bottom of the base horizontal reference line. This board serves both as a guide and as a support for the tiles until the adhesive has a chance to set.

The first tile is set in a corner and twisted slightly to set it into the adhesive. Working in a pyramid shape from the crossed reference lines, the tiles are laid outward and upward. Once the tiles are in place, they are set into the adhesive, all at the same height. After all the whole tiles are set, the edges and trim tiles are used.

Once the tile adhesive is dry, grout is placed over the tile. There are two different types of grout: sanded and non-sanded. Sanded grout has sand added for strength. It is used for joints wider than 1/16", like larger tile on floors. Non-sanded grout is usually mixed with a latex additive to make it stronger and more workable. It is used for joints less than 1/16 for smaller wall and countertop tiles. The color of grout can greatly effect the look of tile. Generally, using a white or a light colored grout highlights the color in tile. Using a light grout with a light tile is good for hiding any mistakes made in setting the tile. Choosing a dark grout with a light tile, or light grout with a dark tile emphasizes the geometric pattern of layout. Gray is a good neutral color and it wears well on floors. It also looks good with natural-looking tiles like terra cotta.

Generally, the grout is mixed to the consistency of a thick paste and applied by forcing the grout between tiles with a rubber float held at a 45-degree angle. Then excess grout is wiped from the surface of the tiles. Alternately, the surface is wiped with a damp sponge. To recess the joints, joints are struck by gently drawing a wooden dowel or the handle of a toothbrush along the soft grout.

Seams are then with a bead of flexible water-soluble silicone caulking. After the grout has cured for a week, silicone grout sealer may be applied with a small paintbrush to retard grout discoloration. Typically, the use a padded grout float is used to spread the grout over a workable section of tile, pushing the grout diagonally across the joints to force it down into the gaps. All the joints are filled with grout except those that need expansion joints. These would be along fixtures, between the floor and walls, or joints in corners in between walls. These get sealed with caulk.

Caulk color should match the grout. Caulk in the areas that are left for expansion joints, and over joints that may crack because of movement. These areas are between floor tile and a cabinet toekick; between floor or wall tile and a bathtub or shower; between floor and wall tile; and at the inside corner where two walls meet.

Further, there are two different ways to "seal" tile; sealing the grout joints, and sealing the tile itself. Basic glazed ceramic tile only requires the grout joints to be sealed. This makes them more water and mildew resistant, and help keep dirt out of the joints. If porous material like slate, marble or terra cotta is installed, the entire surface of the tiles should be sealed to prevent them from getting stained with use. An acrylic topcoat on the tile surface may be used.

Although not intended, set tiles break. Movement of wall supports, warping of building studs, or a shifting foundation can cause tiles to crack. Improper floor and wall preparation during the original installation can cause tiles to loosen. So can moisture or excessive vibrations, such as slamming doors or windows.

Cracked or broken ceramic tiles that are set over drywall are difficult to replace properly, because the drywall is usually also damaged and may need to be repaired first. When installing new ceramic tile, some tiles should be saved in case the need to replace a few arises. It's almost impossible to buy a new tile to match your existing one.

If a single tile has been cracked or chipped, it can usually be repaired without replacing the underlayment. To replace one tile, the grout is first dug around it with a grout saw. The broken tile is then shattered into small pieces by hitting it with a hammer and a nail set or chisel. The pieces are paired out and the grout and adhesive are removed with a chisel or putty knife. A new one tile is set with a silicone adhesive. Then the tile is pressed into place and cleaned any of the adhesive that oozes through the joints. A wall tile is replaced by taping a new tile into place until it dries. When only grouting a small area, a little container of premixed grout may do. The grout is worked into the joints with a grout float.

Inherent Tile Unevenness

Clay is a material that, no matter how flat or square the clay is prior to heating, is subject to deformations or alterations upon heating that cause every ceramic tile to vary in size from one another. Therefore, no two ceramic tiles are exactly same size. When ceramic tiles are placed in concert with each other (i.e. rows comprising several tiles placed next to each other), the accumulated error from the slight variation in size between individual tiles an become unsightly even after the placement of just a few adjacent tile, no matter how careful the installer is when laying the tiles. This error causes separate rows of tiles to terminate at different stopping points, even though each row comprises the same in size and shape of tiles, all made by the same manufacturer, and even when the same number of tiles are used in each row.

This error factor accumulation also occurs when laying stone or marble tile, not just ceramic tiles. Stone is cut into tiles of uniform thickness and size. However, stone cutting is a process that requires extensive labor to position the stone to be cut, no matter how well designed the cutting machine. As a result, no two stone tiles will ever be the same size.

Whether installing ceramic or stone tile, any tile application system that does not contemplate the variables in tile composition and production will produce a visually unpleasant and undesirable placement of tile.

To compensate for these variables when laying tile on a floor or staking tile on a wall, professional installers constantly provide micro-adjustments to the space between tiles. Typically, the installer uses materials on the job site to fashion tools the installer uses to provide an even and uniform appearance to the tiles after they have been set in place. In one example, installers place wedge-like pieces between adjacent tiles in order to adjust the distance between the tiles. Pieces of paper or cardboard, folded to create varying thicknesses, or scrap ceramic or stone tile that has been cut with tile nippers or pliers so that a wedge-shaped piece is created from the broken fragments of tile are the most common materials used on the job site by tile applicators for providing these adjustments. The fragments are inserted between adjacent tiles to adjust for the size differences that exist between rows of tiles stacked or laid together. Yet, this process is cumbersome and lengthens the tile application time, as well as creates unsatisfactory results when trying to make constant adjustments.

In addition, though some ceramic tiles may have a grout spacer provided when the ceramic tiles are manufactured, many European ceramic tiles and all stone tiles do not provide this benefit when manufactured, resulting in the need for a constant unit of measurement to maintain uniform grout thickness. Tile spacers are known that are made from plastic, usually forming a cross, each piece comprising the cross having the same thickness. This type of spacer can be applied at every intersection of four corners of adjacent tiles, each tile contributing one corner, in a uniform fashion.

However, cross-type tile spacers are of uniform thickness, and do not take into account the varying sizes of tiles as described above. Thus, a tile installer may provide an installation having uniform grout thickness using the crosses, but that does not mean the tiles will maintain a uniform height with even rows top to bottom and left to right, without the need for further micro-adjustments. When installed, tile loses its vertical plumb, or its horizontal level, over short distances. What is needed is a spacer, and a method of using spacers, which can compensate for these conditions, which spacer must be easy to use and install. Further, any improved tile spacer also should be capable of providing rapid adjustment of the plumb and level variables while the tiles are being installed.

Thus, it can be seen that there is a need for a method and apparatus for laying tile while maintaining uniform regulation of horizontal level, vertical plumb and spacing between rows and columns of the tiles, said method comprising spreading and adhesive material on the substrate to which said tiles are to be applied.

BRIEF SUMMARY OF THE INVENTION

Briefly described, in a preferred form, the present invention overcomes several disadvantages in conventional tile installation by providing tile regulators and a method of using them that provide both the proper grout spacing between tiles and vertical and horizontal plumb levels of the tiles, which regulators enhance the ease of installing the tiles and the final appearance of the newly laid tile.

One of several important aspects of this invention is that it incorporates the usage of maintaining vertical plumb and horizontal level with a leveling tool. The single most important element in laying tile or stone is the function of gravity, and it is the ancients who invented the plumb bob and the water level to master the effects of gravity in construction to build within the limits of gravity. This tile invention provides the regulator essential to the laying of tile or stone to maintain the appearance of plumb and level, in conduction with a water level or a plumb bob.

Various ancient cultures, including Egypt, Greece, Rome, and China, based some or most of their artwork and construction on the 3-4-5 triangle. This triangle is the ancient reckoning system for establishing right angles to determine level and plumb. History has assigned this reckoning system with the name the Pythagorean Theorem. This theory provides one to achieve a translation between right triangles and to establish a square. Tile is probably one of the most ancient forms of building materials that has endured because of it's extreme durability and also as a form of expression for artists. It is also a material based upon the right angle and most ancient forms of architecture have incorporated the use of tiles, whether mosaic or diagonal, on the square. The single point of construction is the use of this right angle theory with the use of a plumb bob or a water level. The function of gravity is the unalterable unit of measurement that establishes the function of square, and there is no product that can be used in construction that does not take this unit of measurement in consideration.

Likewise, there is no tile product that does not depend on anything less than the measurement o f the right angle to be installed properly. As has been established, there is no tile or stone product that is not perfectly square, and as a result, the act of building or laying tile within a right angle will inevitably result in the loss of plumb or level without some minor adjustments to repair the inaccuracies of man made products. This has been a constant labor factor for any tile installations, from ancient civilization to current history.

In an effort to overcome the above problems, the present invention is a tool that will effectively repair the vertical plumb and horizontal level in a fast, convenient, and economical manner, in the process of installing ceramic or stone tile on floors or walls. The present tile regulators are designed to compensate for the existing limiting conditions associated with conventional regulating products.

A preferred tile regulator used to maintain uniform regulation of horizontal level, vertical plumb and spacing between rows and columns of the tiles comprises a wedged-shaped element having a thickness defined as the distance between a top and bottom surface of the element. The element has a front and back end, wherein the top and bottom surfaces diverge from a point of meeting at the front end of the wedged-shaped element. Preferably, the top and bottom surfaces extend from the point of meeting to the back end of the element, wherein the back end of the element has a thickness greater than the thickness of the front end of the element.

Further disclosed herein are methods of using different embodiments of the tile wedge/regulator to lay tiles on a substrate to maintain uniform regulation of horizontal level, vertical plumb and spacing between rows and columns of the tiles by spreading an adhesive material on the substrate, placing tiles in columns and rows on the substrate and in contact with said adhesive, and placing wedge/regulator elements between the edges of adjacent tiles.

These and other objects, features, and advantages of the present invention will become more apparent upon reading the following specification in conjunction with the accompanying drawing figures.

DETAILED DESCRIPTION OF THE PREFERRED EMBODIMENT

Figure 3A:
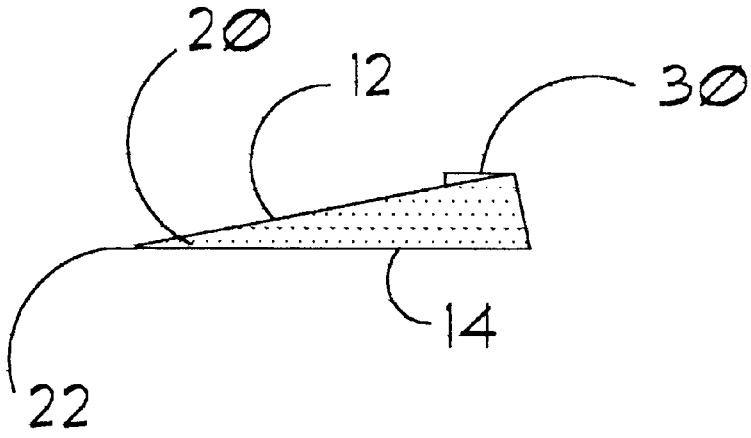
FIGS. 3A–3C illustrate embodiments of three tile regulators having distinct property specifications.

Referring now in detail to the drawing figures, wherein like reference numerals represent like parts throughout the several views, in a preferred embodiment, the present invention comprises tile wedges 10 having a top surface 12 and a bottom surface 14. As shown in FIG. 3A, tile wedge 10 preferably comprises a point 22 located at a front end 20 wherein surfaces 12, 14 meet. From point 22, surfaces 12, 14 diverge and extend to a back end 30.

Figure 3B:
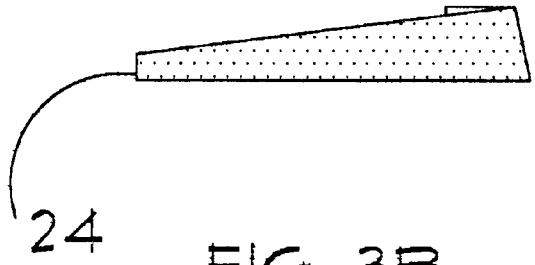
Figure 3C:
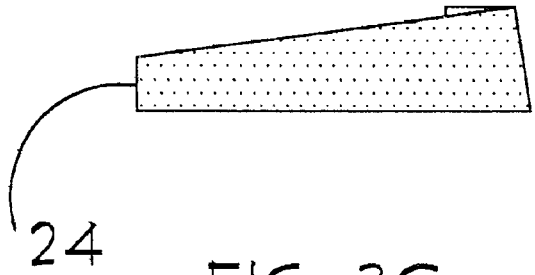

Wedge 10 can take on several embodiments simply by altering the pitch of the angle of divergence between surfaces 12, 14. Further, as shown in FIGS. 3B and 3C, the front end 20 of wedge 10 can comprise a blunt nose 24 if surfaces 12, 14 do not join at a point 22. Wedge 10 can be formed of various compositions, for example, plastics, and can vary in width or length.

Wedge 10 is capable of providing a number of adjustment functions during tiling. Generally, the shape of the wedge 10 is that of a wedge having a thickness which increases from the front end 20 toward the back end 30, so that adjustments can be made to raise the edge or corner of a tile 100 to match the edging corner of an adjacent tile. In this way the tiles, no matter how distorted, can be adjusted to even for the next rows of tiles to be applied to maintain as straight line as possible. The wedge 10 being thinner at the front end 20 and thicker at the back end 30 over a gradual distance of the thickness of a tile (typically ¼" to 1" thick) can be inserted between each tile at varying depths that permit the corner of a tile to raise up as much as is necessary to match the adjoining corner of the next tile, and still maintain the grout space 50 between each tile so that the appearance of an even thickness of grout remains the same.

In another use, wedge 10 is placed between adjacent tiles 100 perpendicular to the plane of the tile application, front end 20 first. Since wedge 10 comprises a wider thickness moving from its front end 20 to its back end 30, the further wedge 10 is tapped between adjacent tiles 100, the wider the space 50 between the tiles 100.

The width of the present tile wedge 10 can be any width that will have the structural integrity to permit the wedge 10 to be pushed between tiles after they have been applied and before the underlayment adhesive has set so that the adhesive does not permanently harden prior to leveling the tile to match the other tile. The wedge 10 can be of a comfortable size so that the wedges 10 can be easily held and inserted in rapid succession so as to cover a large distance quickly. The length of the wedge 10 should be long enough to be applied by the installer using at least two fingers, and still permit the wedge 10 to protrude outside the surface of the tile so that it can be pushed on or pushed in the adhesive to elevate the corner or edge of the tile and to regulate the space necessary to provide proper tile alignment.

The length of the tile wedge 10 should average a minimum length of 30 to 40 mm to be easily held and manipulated as described above. The width of the tile wedge 10 is determined by the type of material of which the tile wedge 10 is manufactured, so as to maintain structural integrity as it is placed between the tile joint 50. The material of the wedge 10 should be resistant to water and the effects of a lime/calcium base prevalent in cement-based tile adhesive which can be caustic to some materials and leave stains or pieces of the wedge in the grout joint 50 and cause damage to the desired finish.

The point 22 of the wedge 10 at the front end 20 should be thin enough both to be inserted in-between tiles that may not require a large grout joint 50, and permit the minimum movement of adjustment and not require additional pressure or force to intercede when installing the tile wedge 10. This is particularly important when installing tiles that require a minimum joint or grout space 50. The present wedge 10 will be used mostly for leveling or plumbing tiles as opposed to setting grout joint 50 thickness.

When the tile wedges 10 are being used to maintain uniform grout joint 50 thickness, a smaller wedge can be used coupled with a larger wedge to provide the same function as when being used singularly for level and plumb adjustments without affecting the size of the grout joint 50. The wedges 10 can be made of plastic with a dedicated color for each different size wedge 10 so that when different sizes of wedges 10 are placed together, it is possible to distinguish size allocations when work is in progress to mount or lay tiles.

When the tile wedges 10 are to be used primarily as a grout spacer the width of the wedge 10 correlates with the thickness of the wedge 10 so that the material is always adaptable to be used with two fingers. A width of 6 to 9 mm is preferable for the function of being held by two fingers with a minimum length of 30 to 40 mm. The thickness of the point 22 of the wedge 10 should correlate to the thickness of the grout desired. For grout joints 50 of an approximate 1/16" width size, the section of the wedge 10 should approximate the desired thickness at a point that the wedge 10, when it has been inserted between the tiles, the desired thickness for grout 1/16" will have been achieved, and still allow the flexibility to permit the wedge 10 to be used either forward or backward to maintain visual accuracy and correct grout thickness. The unit of accuracy is regulated so that as the wedge 10 is inserted between the tiles, the ideal thickness desired will occur before the wedge has penetrated the full thickness of the thin-set and tile thickness combined. This provides the maximum flexibility for minor adjustments. The weight of the tile is sufficient to hold the wedge in place, whether being used for wall or floor tile.

A wedge 10 can be designed for any grout thickness as a result of this flexibility, whether it be for 1/16", 1/8", 1/4", 1/2" 5/8", or 3/4" size grout joints 50. As each size of grout joint 50 increases, the height (size) of the wedge has to be increased so as to provide a balance between the point of entrance between the tiles and the section of wedge providing the desired width (for example, 1/2") before the point of the wedge has fully penetrated the thin-set mortar and bottoms out on the backer board.

In one embodiment, to create a uniform system of wedges 10, each wedge 10 size is colored differently from another size so that the tile installer will have the greatest control since speed of installation is important to install a tile before the thin-set has hardened and the tile is no longer movable, and for reducing time of installation. Color indicates the various sizes of each wedge 10, and after the installation has been completed, the sizes can be sorted by color and re-used in the future.

The present system, in its simplicity, eliminates a constant limitation in the manufacturing of tiles, whether in stone or clay, to provide for the micro-adjustments in the application of tile to offset the irregularities of a man-made product as tile. In addition, it assists the tile installer to not only provide perfect visual level and plumb tiles during installation, but also creates the desired grout joint 50 widths with a minimum of effort and increased efficiency so that work time is reduced in human labor and profits are increased in relation to square foot costs for tile installers.

Figure 1:
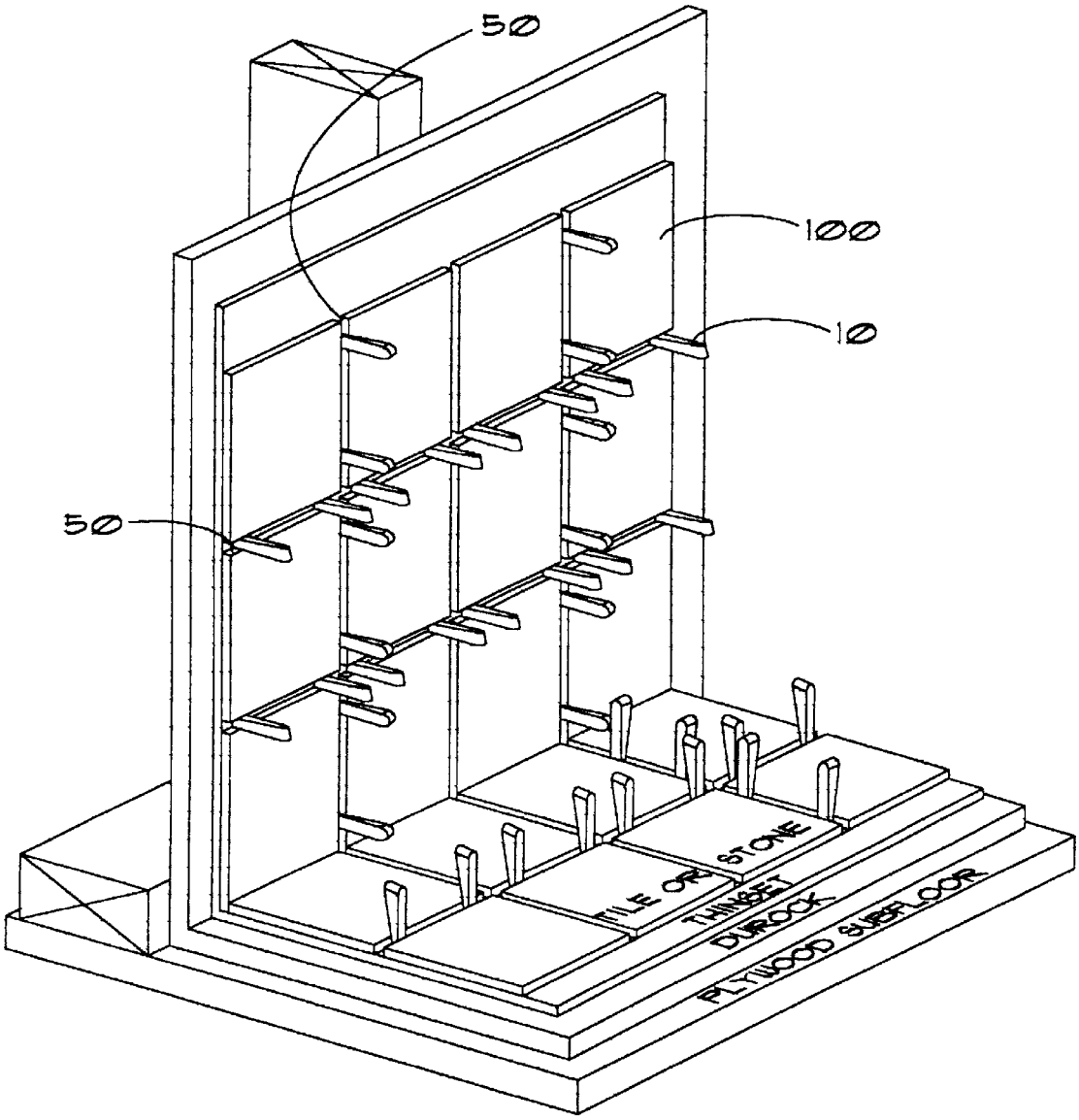
FIG. 1 is a perspective view of a wall and floor tile assembly with the tile wedge/regulators of the present invention providing an equal grout space between tiles, and regulating the vertical plumb and horizontal level of the tiles.

FIG. 1 illustrates the use of tile wedges 10 providing equal grout spaces 50 between tiles 100, and also as a tool to regulate vertical plumb and horizontal level in tile laying applications. Wedges 10 can be inserted during laying and application of tiles 100, or after application of tiles 100, prior to the setting or hardening time of underlayment or thin-set mortar. The wedges 10 can be removed easily by hand after such setting or hardening of underlayment material has occurred.

Figure 2:
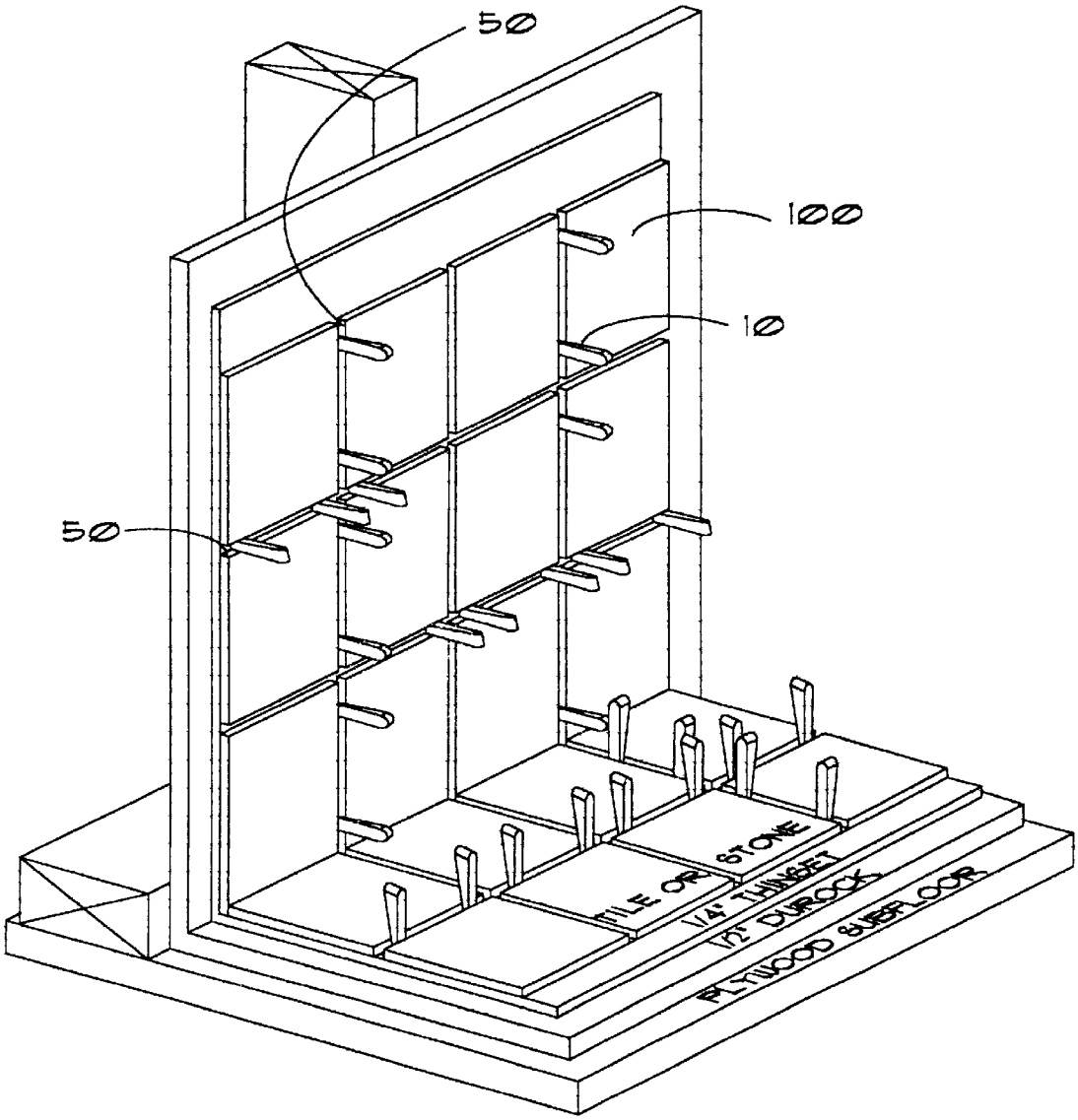
FIG. 2 is a perspective view of a wall and floor tile assembly with the tile wedge/regulators of the present invention solely regulating the vertical plumb and horizontal level of the tiles

FIG. 2 illustrates the use of tile spikes 10 solely as a function of regulating the vertical plumb and horizontal level during the application of tile 100.

FIGS. 3A–3C illustrate ways of distinguishing tile wedge 10 sizes by coloring the wedges 10 to denote measurements of thickness to facilitate the proper grout spacing during application of tiles 100. It further demonstrates the multi-function of combining wedges 10 to increase or decrease grout spacing as is necessary to facilitate the vertical and horizontal plumb without diminishing the aspect of grout spacing.

Figure 4:
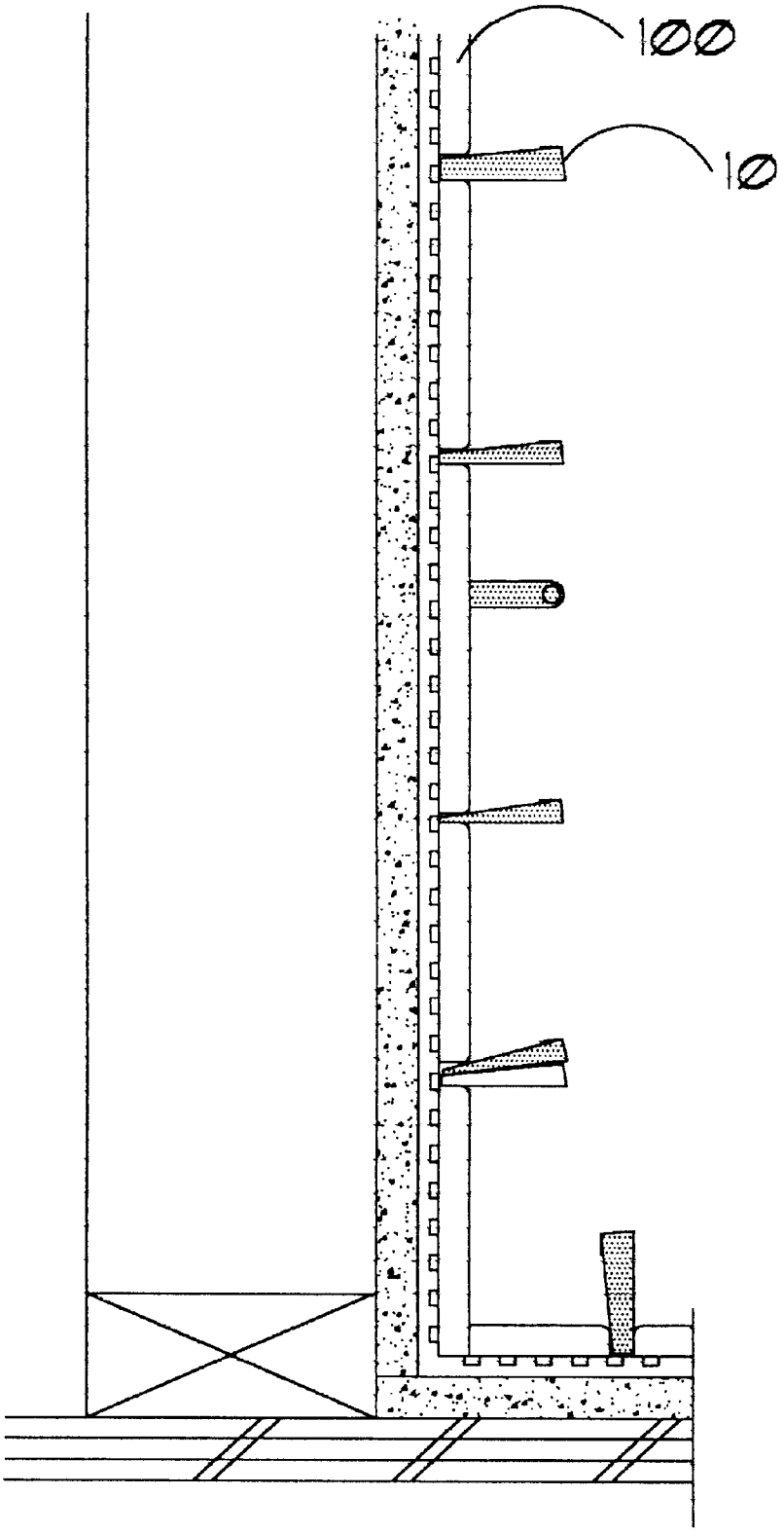
FIG. 4 is a side view of a wall and floor tile assembly with the tile wedge/regulators of the present invention providing an equal grout space between tiles, and regulating the vertical plumb and horizontal level of the tiles.

FIG. 4 illustrates one representation of the size, shape, and color of the tile wedges 10 according to a preferred embodiment. Color may vary for each size of wedge thickness.

While the invention has been disclosed in its preferred forms, it will be apparent to those skilled in the art that many modifications, additions, and deletions can be made therein without departing from the spirit and scope of the invention and its equivalents as set forth in the following claims.

What is claimed is:

1. A method of laying tiles on a substrate to maintain uniform regulation of horizontal level, vertical plumb and spacing between rows and columns of the tiles, said method comprising the steps of:

(a) spreading an adhesive material on the substrate;

(b) placing tiles in columns and rows on the substrate and in contact with said adhesive;

(c) placing a tile regulator a depth between the edges of adjacent tiles so that a top surface of the tile regulator is in contact with one of the adjacent tiles, and a bottom surface of the tile regulator is in contact with the other of the adjacent tiles, said tile regulator comprising a wedged-shaped element having a thickness defined as the distance between the top and the bottom surfaces of the element, said element further having a front and back end, said surfaces diverging from a point of meeting at the front end of said wedged-shaped element, said surfaces extending from said point of meeting to the back end of said element, the back end of said element having a thickness greater than the thickness of the front end of said element; and (d) adjusting the depth at which the tile regulator is placed between adjacent tiles, which in turn adjusts the distance between adjacent tiles at the location of the tile regulator enabling the regulation of horizontal level, vertical plumb and spacing between the rows and columns of the tiles on the substrate.

2. The tile regulator of claim 1, said bottom surface of the regulator being between about 30 mm to 40 mm long.

3. The tile regulator of claim 2, said bottom surface of the regulator about 37 mm long.

4. The tile regulator of claim 1, said surfaces of the regulator element being between about 6 mm to 9 mm wide.

5. The tile regulator of claim 4, said surfaces of the regulator element being about 7.5 mm wide.

6. The tile regulator of claim 1, the back end of the regulator element having a thickness of between about 0.01 to 10 mm.

7. The tile regulator of claim 6, the back end of the regulator element having a thickness of about 0.025 mm.

8. The tile regulator of claim 6, the back end of the regulator element having a thickness of about 2.5 mm.

9. The tile regulator of claim 6, the back end of the regulator element having a thickness of about 5 mm.

10. A method of regulating horizontal level, vertical plumb and spacing between rows and columns of tiles, the method comprising the steps of:

(a) placing a tile regulator a depth between the edges of two adjacent tiles so that a top surface of the tile regulator is in contact with one of the adjacent tiles, and a bottom surface of the tile regulator is in contact with the other of the adjacent tiles, the tile regulator incorporating a wedged-shaped element having a thickness defined as the distance between the top and the bottom surfaces of the element, the element further incorporating a front and back end, the top and bottom surfaces diverging from a point of meeting at the front end of the wedged-shaped element, the top and bottom surfaces extending from the point of meeting to the back end of the element, the back end of the element having a thickness greater than the thickness of the front end of the element;

(b) adjusting the depth at which the tile regulator is placed between adjacent tiles, which in turn adjusts the distance between adjacent tiles at the location of the tile regulator enabling the regulation of horizontal level, vertical plumb and spacing between rows and columns of tiles; and (c) removing the tile regulator by hand upon completion of the regulation of horizontal level, vertical plumb and spacing between adjacent tiles.

11. The method of regulating horizontal level, vertical plumb and spacing between rows and columns of tiles according the claim 10 comprising the further step of providing a plurality of tile regulators from which to select a tile regulator to be placed between adjacent tiles, the plurality of tile regulators being color-coded in more than one color, the tile regulators of a specific color having uniform dimensions.

12. A method of regulating horizontal level, vertical plumb and spacing between rows and columns of tiles, the method comprising the steps of:

(a) spreading an adhesive material on the substrate;

(b) placing tiles in columns and rows on the substrate and in contact with said adhesive;

(c) providing a plural of the regulators being color-coded in at least two different colors, the tile regulators of a specific color having uniform dimensions;

(d) placing a tile regulator a depth between the edges of two adjacent tiles so that a top surface of the tile regulator is in contact with one of the adjacent tiles, and a bottom surface of the tile regulator is in contact with the other of the adjacent tiles, the tile regulator incorporating a wedged-shaped element having a thickness defined as the distance between the top and the bottom surfaces of the element, the element further incorporating a front and back end, the top and bottom surfaces diverging from a point of meeting at the front end of the wedged-shaped element, the top and bottom surfaces extending from the point of meeting to the back end of the element, the back end of the element having a thickness greater than the thickness of the front end of the element;

(e) adjusting the depth at which the tile regulator is placed between adjacent tiles, which in turn adjusts the distance between adjacent tiles at the location of the tile regulator enabling the regulation of horizontal level, vertical plumb and spacing between rows and columns of tiles; and (f) removing the tile regulator by hand upon completion of the regulation of horizontal level, vertical plumb and spacing between adjacent tiles.

* * * * *